US011050192B2

(12) United States Patent
Qiu et al.

(10) Patent No.: US 11,050,192 B2
(45) Date of Patent: Jun. 29, 2021

(54) ELECTRIC CONNECTOR WITH CONNECTOR POSITION ASSURANCE

(71) Applicant: LEAR CORPORATION, Southfield, MI (US)

(72) Inventors: Shi Qing Qiu, Shanghai (CN); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/686,666

(22) Filed: Nov. 18, 2019

(65) Prior Publication Data

US 2020/0212630 A1 Jul. 2, 2020

(30) Foreign Application Priority Data

Dec. 29, 2018 (CN) ..... 201811641033.9

(51) Int. Cl.

| | |
|---|---|
| ***H01R 13/641*** | (2006.01) |
| ***H01R 13/506*** | (2006.01) |
| ***H01R 33/20*** | (2006.01) |
| ***H01R 13/639*** | (2006.01) |

(52) U.S. Cl.

CPC ..... *H01R 13/641* (2013.01); *H01R 13/506* (2013.01); *H01R 13/639* (2013.01); *H01R 33/20* (2013.01)

(58) Field of Classification Search

CPC .. H01R 13/641; H01R 13/506; H01R 13/639; H01R 33/20

USPC ..... 439/352

See application file for complete search history.

(56) References Cited

U.S. PATENT DOCUMENTS

| | | | | |
|---|---|---|---|---|
| 4,255,007 | A * | 3/1981 | Michaels | H01R 23/26 439/295 |
| 5,572,396 | A * | 11/1996 | Robinson | G01R 1/36 361/117 |
| 6,206,714 | B1 * | 3/2001 | Bernardini | H01R 13/213 439/166 |
| 6,297,741 | B1 * | 10/2001 | Higgins | F15B 21/041 340/631 |
| 6,808,407 | B1 * | 10/2004 | Cannon | H01R 13/625 439/314 |
| 7,063,565 | B2 * | 6/2006 | Ward | H01R 9/0524 439/578 |
| 7,503,794 | B2 * | 3/2009 | Haller | H01R 13/6273 439/332 |
| 7,556,514 | B1 * | 7/2009 | Sorensson | H01R 13/703 200/51 R |
| 7,641,499 | B1 | 1/2010 | George et al. | |
| 7,811,115 | B1 | 10/2010 | Tyler | |
| 8,083,533 | B2 | 12/2011 | De Chazal | |
| 8,215,977 | B2 * | 7/2012 | Zapf | H01R 13/625 439/352 |

(Continued)

*Primary Examiner* — Harshad C Patel

(74) *Attorney, Agent, or Firm* — MacMillan, Sobanski & Todd, LLC

(57) ABSTRACT

An electrical connector includes a connector housing. A latch on the connector housing is movable between an opened position and a closed position. The electrical connector also includes a connector position assurance. The connector position assurance is supported on the connector housing for relative rotational movement about a connector axis between a locked position and an unlocked position. When the connector position assurance in the locked position, the latch is prevented from moving from the closed position to the opened position.

15 Claims, 13 Drawing Sheets

(56) References Cited

U.S. PATENT DOCUMENTS

| | | | | |
|---|---|---|---|---|
| 8,234,744 | B2 | 8/2012 | Seng et al. | |
| 8,500,486 | B2 * | 8/2013 | Buck | H01R 13/74 439/551 |
| 8,585,415 | B2 * | 11/2013 | Marsh | H01R 13/6584 439/98 |
| 8,597,043 | B2 | 12/2013 | Zhao | |
| 9,054,452 | B2 * | 6/2015 | Yamada | H01R 13/625 |
| 9,093,769 | B2 * | 7/2015 | Youn | H01R 13/53 |
| 9,099,809 | B2 | 8/2015 | George et al. | |
| 9,252,509 | B2 * | 2/2016 | Kato | H01R 13/6581 |
| 9,252,539 | B2 * | 2/2016 | Condo | H01R 13/707 |
| 9,397,459 | B2 * | 7/2016 | Butcher | H01H 85/54 |
| 9,559,457 | B2 | 1/2017 | Strahl | |
| 10,559,933 | B1 * | 2/2020 | Menzies | B60L 3/04 |
| 2003/0013338 | A1 * | 1/2003 | Birkenmaier | H01R 13/745 439/332 |
| 2015/0251551 | A1 * | 9/2015 | Mueller | B60L 53/18 320/109 |

* cited by examiner

ELECTRIC CONNECTOR WITH CONNECTOR POSITION ASSURANCE

BACKGROUND OF THE INVENTION

This invention relates to an electric connector. More specifically, this invention relates to an electric connector with a connector position assurance.

Some types of electric machines use relatively high voltage to power components of equipment. For example, electric and hybrid cars include high voltage batteries that provide power to the drive motors. The high voltage batteries are connected to a high voltage circuit to provide current flow to the drive motors or other high voltage equipment. A high voltage disconnect is typically provided to allow the batteries to be selectively disconnected from the high voltage circuit. The high voltage disconnect includes an electric connector that can be attached and detached from a header connector. An example of a high voltage disconnect is shown in U.S. Pat. No. 7,811,115, the disclosure of which is hereby incorporated by reference in its entirety.

The electric connector includes electric terminals for closing the high voltage circuit, as well as low voltage electric terminals for closing a second, low voltage circuit. When the electric connector is disconnected from the header, the low voltage electric terminals are disconnected first, which opens an interlock loop. The electric terminals for the high voltage circuit are disconnected second, after a delay following the interlock loop being opened. The high voltage disconnect described in the U.S. Pat. No. 7,811,115 includes a latch that is released in multiple stages involving a thumb actuation pad and a tool actuation block. This requires the operator to take multiple steps to disconnect the electric connector for the header, which introduces the delay.

A controller monitors the interlock loop. When the interlock loop is opened, the controller disconnects current flow through the high voltage loop. The delay allows time for any residual voltage in the high voltage circuit to be discharged before the electric terminals for the high voltage circuit are disconnected. This helps to avoid damage to the electric terminals that could be caused by arcing of the residual voltage. When the electric connector is attached to the header, the high voltage circuit is closed first, and the interlock loop is closed second. The controller will prevent current flow in the high voltage circuit until the interlock loop is closed.

When the electric connector is attached to the header, the connection is sealed against moisture and other contaminants. Additionally, the connection includes electromagnetic shielding in order to prevent the current flow through the terminals from interfering with other electric components. It would be advantageous to have an alternative sealed, shielded, high voltage electric connector that includes an interlock loop.

SUMMARY OF THE INVENTION

This invention relates to an electric connector. The electrical connector includes a connector housing. A latch on the connector housing is movable between an opened position and a closed position. The electrical connector also includes a connector position assurance. The connector position assurance is supported on the connector housing for relative rotational movement about a connector axis between a locked position and an unlocked position. When the connector position assurance is in the locked position, the latch is prevented from moving from the closed position to the opened position.

Another embodiment of this invention relates to an electric connector assembly. The electric connector assembly includes a first electric connector with a first connector housing. The first connector housing has a latch that is movable between an opened position and a closed position. The first electric connector also includes a connector position assurance supported on the first connector housing for relative rotational movement about a first connector axis between a locked position and an unlocked position. The electric connector assembly also includes a second electric connector. The second electric connector is movable relative to the first electric connector between an initial position and a mated position. The second electric connector has a second connector housing with a connector catch. The connector catch is engaged by the latch to retain the second electric connector in the mated position when the latch is in the closed position. When the connector position assurance is in the locked position, the latch is prevented from moving from the closed position to the opened position.

Various aspects of this invention will become apparent to those skilled in the art from the following detailed description of the preferred embodiment, when read in light of the accompanying drawings.

BRIEF DESCRIPTION OF THE DRAWINGS

FIGS. 15A-22A are schematic views of the relative positions of components of the electric connector assembly when the first electric connector and second electric connector are mated and unmated.

FIGS. 15B-22B are schematic views of the relative positions of electric terminals of the electric connector assembly during each of the steps illustrated in FIGS. 15A-22A.

DETAILED DESCRIPTION OF THE PREFERRED EMBODIMENT

Figure 1:
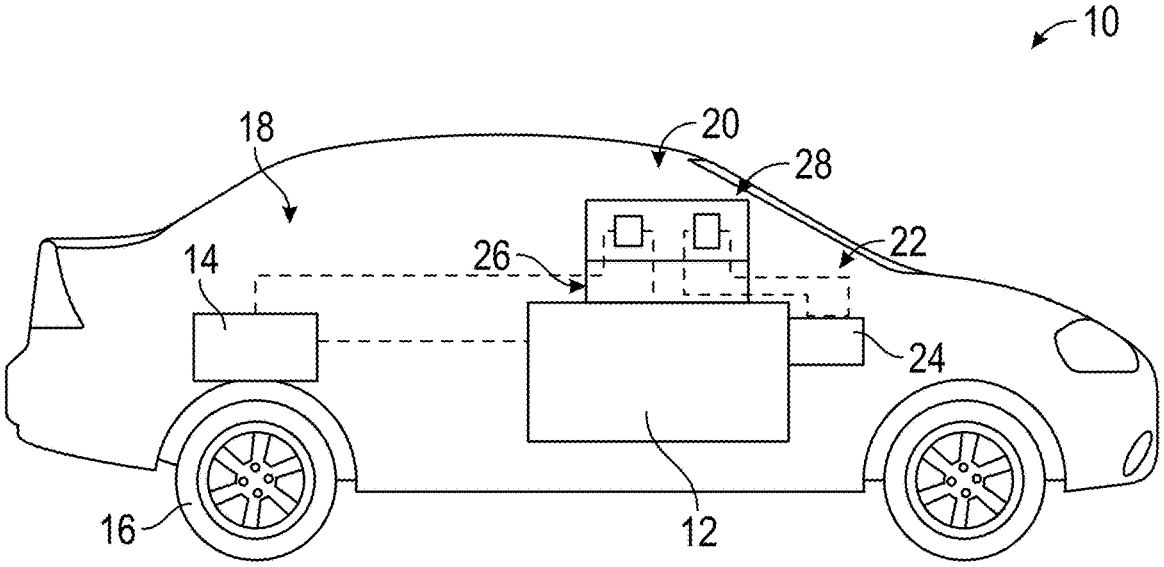
FIG. 1 is a schematic view of an electric vehicle including an electric connector assembly that serves as a battery disconnect.

Referring now to the drawings, there is illustrated in FIG. 1 a schematic view of a vehicle, indicated generally at 10. The vehicle 10 includes a battery 12. The illustrated vehicle 10 is an electric vehicle, but may be a hybrid vehicle or any desired type of vehicle that includes a battery 12. The vehicle 10 includes an electric motor 14 that is connected to drive wheels 16. A primary circuit, indicated generally at 18, provides current flow from the battery 12 through the electric motor 14. The illustrated electric motor 14 is one type of electric equipment that may be connected to the battery 12, and it should be appreciated that any desired electric equipment may be powered by the battery 12 through the primary circuit 18. Furthermore, the invention described herein may be used with any desired electric components and is not limited to use in vehicles.

The vehicle 10 includes an electric connector assembly, indicated generally at 20. The electric connector assembly 20 serves as a battery disconnect and allows an operator to open the primary circuit 18 at the battery 12. This could be done, for example, when the electric motor 14 is to be serviced. It should be appreciated that the primary circuit 18 is only described in a simplified form sufficient for the understanding of the electric connector assembly 20. The preferred embodiment of the invention will be described in connection with the battery 12 on the electric vehicle 10, but it should be appreciated that the invention may be used as an electric connector assembly in any desired circuit.

The illustrated electric connector assembly 20 is also part of an interlock loop, indicated generally at 22. The interlock loop 22 is monitored by a battery control 24. When the interlock loop 22 is open, the battery control 24 disables current flow through the primary circuit 18. When the interlock loop 22 is closed, the battery control 24 permits current flow through the primary circuit 18.

Figure 2:
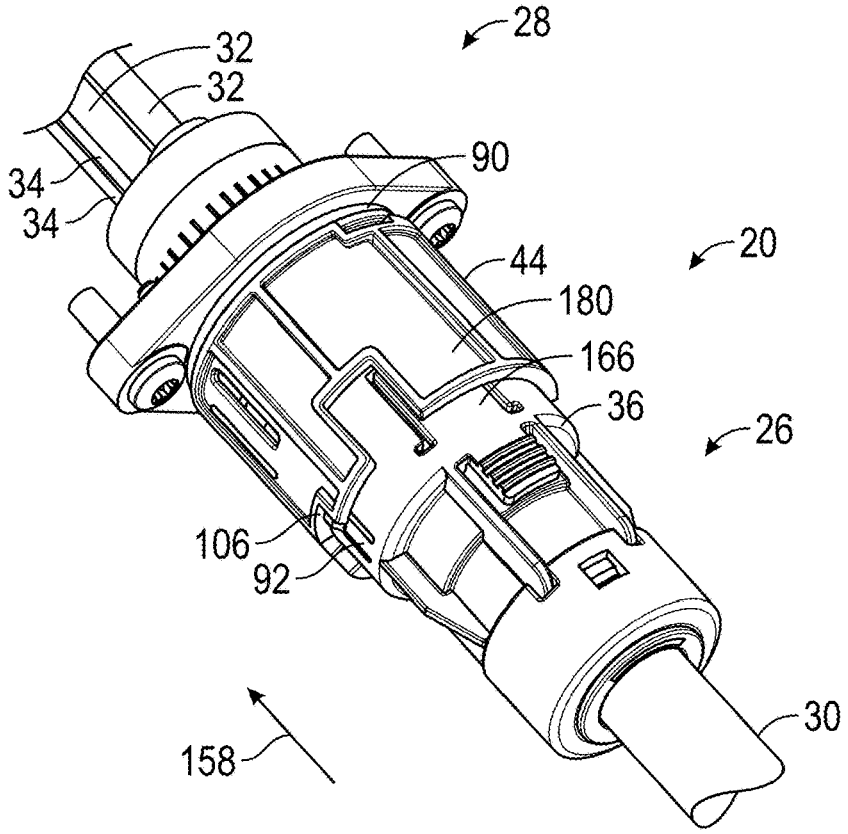
FIG. 2 is a perspective view of the electric connector assembly in accordance with this invention.

Referring to FIG. 2, there is illustrated a perspective view of the electric connector assembly 20, shown in a mated position. The electric connector assembly 20 includes a first electric connector, indicated generally at 26, and a second electric connector, indicated generally at 28. In the illustrated embodiment, the second electric connector 28 is a header that is adapted to be attached to a battery housing (not shown), and the first electric connector 26 is a battery connector. However, the first electric connector 26 and the second electric connector 28 may be used for any desired electric connections.

The first electric connector 26 is connected to a shielded cable 30 that is part of the primary circuit 18. The second electric connector 28 is connected to two second primary conductors 32 that are also part of the primary circuit 18. The second electric connector 28 is also connected to two secondary conductors 34 that are part of the interlock loop 22. A description of how the electric connector assembly 20 opens and closes the primary circuit 18 and the interlock loop 22 will be provided below.

Figure 3:
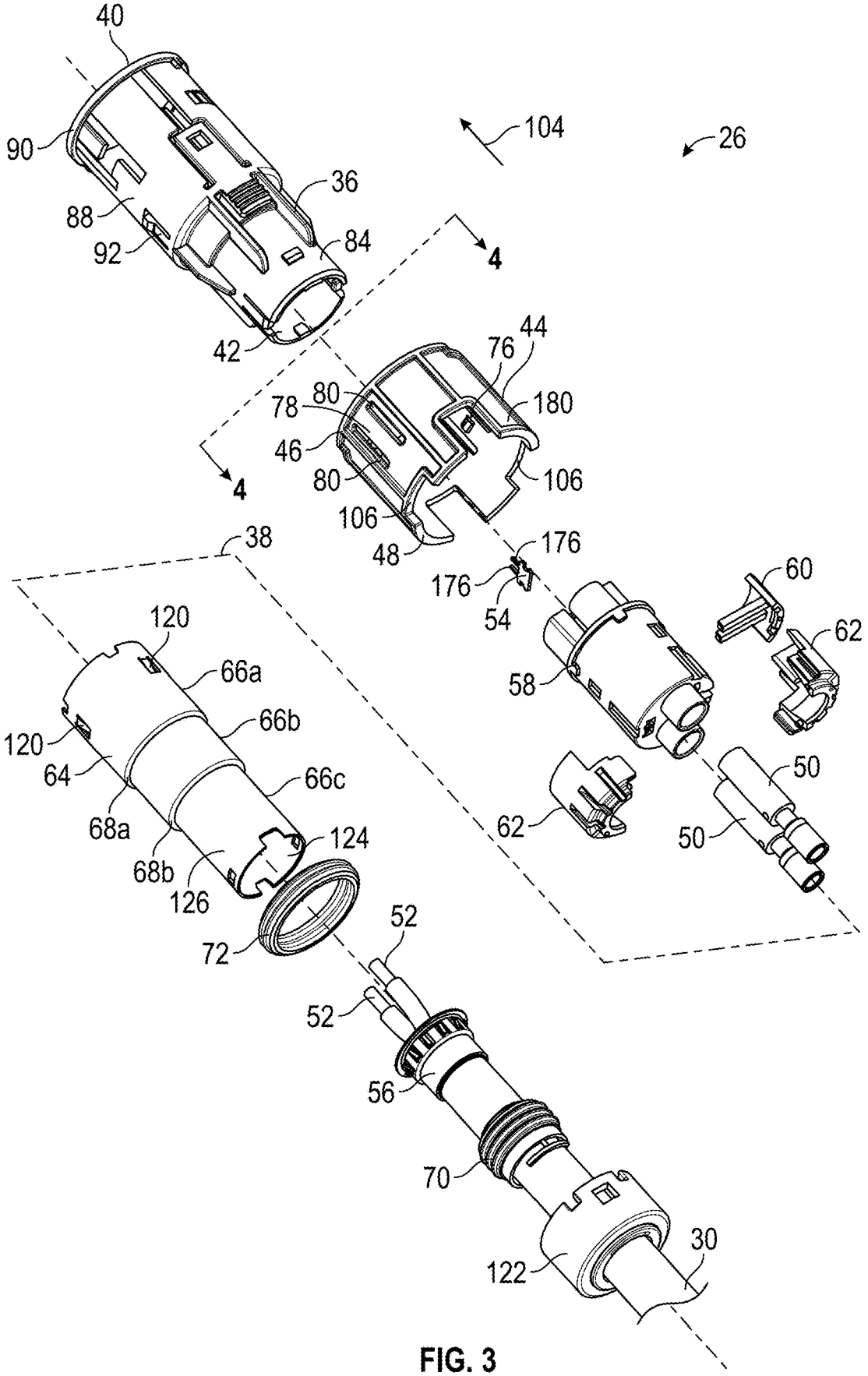
FIG. 3 is an exploded perspective view of a first electric connector of the electric connector assembly illustrated in FIG. 2.

Referring to FIG. 3, there is illustrated an exploded view of the first electric connector 26. The first electric connector 26 includes a first connector housing 36 that extends along a first connector axis 38 from a mate end 40 to a cable end 42. The illustrated first connector housing 36 is molded from plastic, but may be made of any desired material and by any desired process. The first electric connector 26 includes a connector position assurance 44 that extends from an engagement end 46 to a lock end 48. The illustrated connector position assurance 44 is also molded from plastic, but may be made of any desired material and by any desired process. The first connector housing 36 and the connector position assurance 44 will be described in detail below.

The first electric connector 26 includes two first primary electric terminals 50. The illustrated first primary electric terminals 50 are female barrel-type terminals, but may be any desired types of terminals. When the first electric connector 26 is assembled, the first primary electric terminals 50 are connected to respective first primary conductors 52 that extend from the shielded cable 30. The first electric connector 26 also includes a shorting bar 54 that is part of the interlock loop 22. The operation of the first primary electric terminals 50 and the shorting bar 54 will be described below.

The first electric connector 26 includes a ferrule 56 that is connected to the shielded cable 30. The ferrule 56 is made of metal and extends around the circumference of the shielded cable 30. The ferrule 56 is electrically connected to a shield layer (not shown) of the shielded cable 30 and serves to extend electromagnetic shielding from the shielded cable 30 into the first electric connector 26, as will be described below.

The first electric connector 26 includes an inner housing 58. The illustrated inner housing 58 is molded from plastic, but may be made of any desired material and by any desired process. The inner housing 58 supports the first primary electric terminals 50 and the shorting bar 54 when the first electric connector 26 is assembled. A terminal position assurance 60 is adapted to be inserted into the inner housing 58 to ensure that the first primary electric terminals 50 are properly positioned in the inner housing 58. A spacer 62 is located adjacent to the inner housing 58 and maintains a separation between the inner housing 58 and the ferrule 56 when the first electric connector 26 is assembled. The illustrated spacer 62 is a two-part plastic component, but may be made of any desired material and by any desired method.

The first electric connector 26 also includes a first electromagnetic shield 64. The illustrated first electromagnetic shield 64 is a single piece of drawn metal, but may be made of any desired material and by any desired process. The illustrated first electromagnetic shield 64 includes three cylindrically-shaped sections 66*a*, 66*b*, and 66*c* and two steps 68*a* and 68*b* that are located between adjacent sections 66*a* and 66*b* and adjacent sections 66*b* and 66*c*, respectively. When the first electric connector 26 is assembled, the first electromagnetic shield 64 engages the ferrule 56 to extend electromagnetic shielding from the shielded cable 30 into the first electric connector 26, as will be described below.

The first electric connector 26 further includes a cable seal 70 and a housing seal 72. Both the cable seal 70 and the housing seal 72 are elastomeric O-rings, but may be any desired type of seals. The cable seal 70 and the housing seal 72 serve to prevent moisture and contaminants from reaching the first primary electric terminals 50 and the shorting bar 54 when the electric connector assembly 20 is mated, as will be described below.

Figure 4:
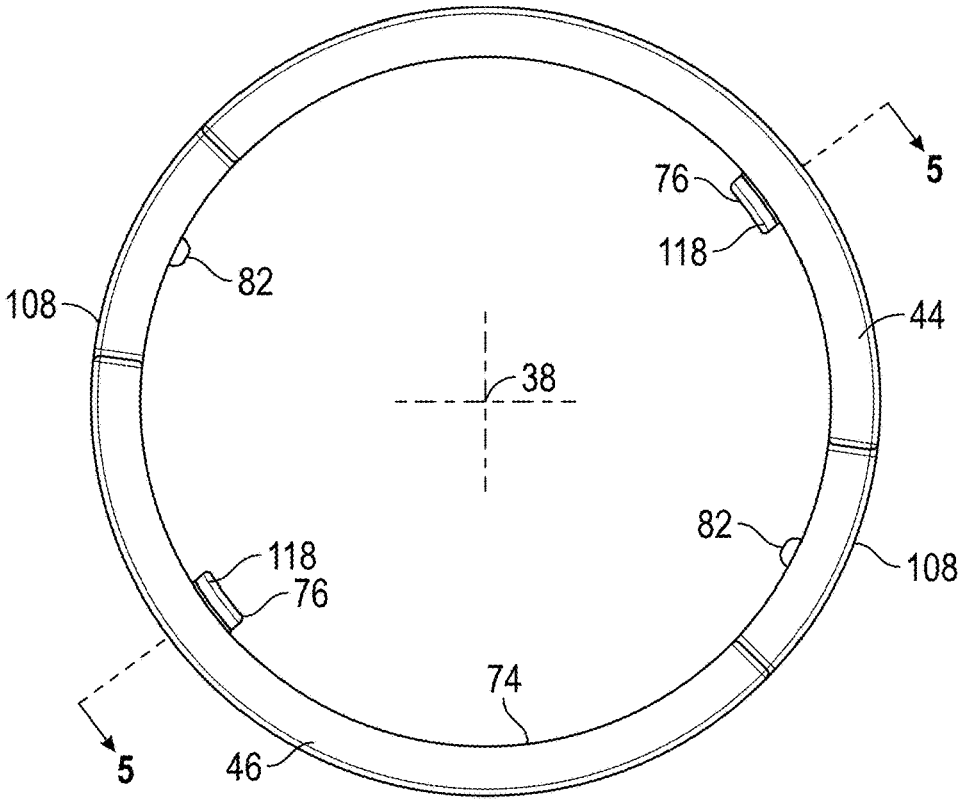
FIG. 4 is an end view of a connector position assurance of the first electric connector.
Figure 5:
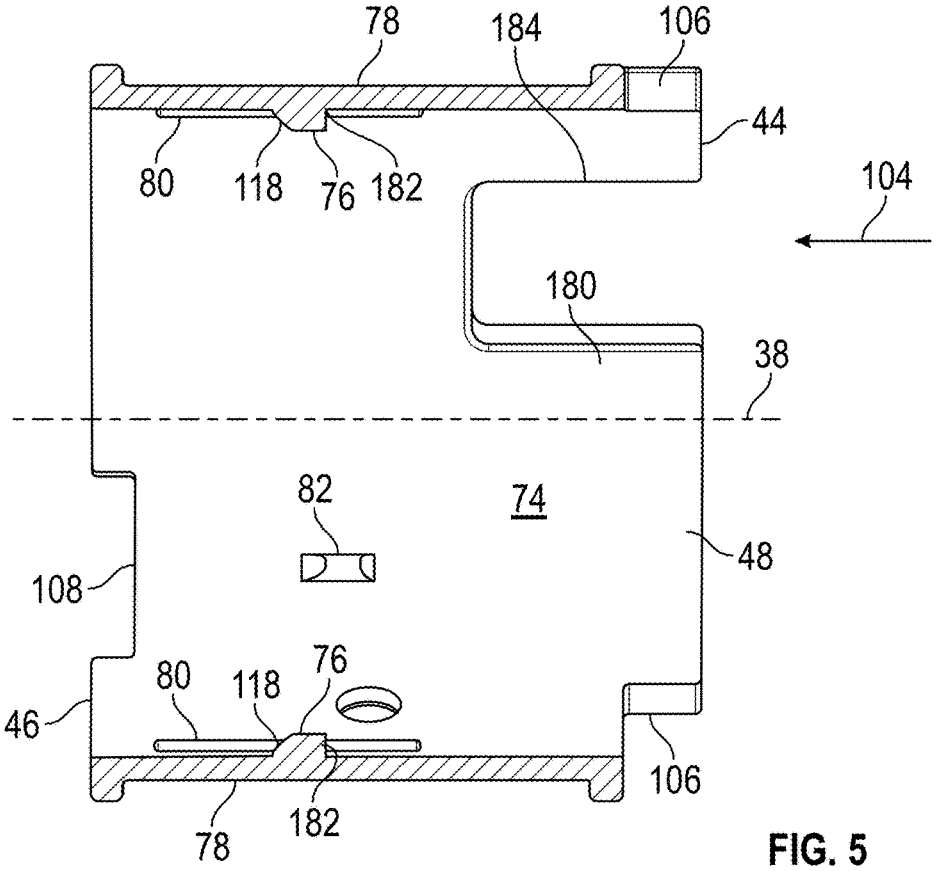
FIG. 5 is a cross-sectional view taken along line 5-5 of FIG. 4.

Referring now to FIG. 4, there is illustrated an end view of the connector position assurance 44, viewed from the engagement end 46. FIG. 5 is a cross-sectional view taken along line 5-5 of FIG. 4. The connector position assurance 44 has a generally cylindrical shape and a circular cross-sectional shape when viewed perpendicular to the first connector axis 38. The connector position assurance 44 includes a connector position assurance inner wall 74 that faces the first connector axis 38. The connector position assurance 44 includes one or more assurance catches 76 that extend inwardly from the inner wall 74. The illustrated connector position assurance 44 includes two assurance catches 76 that are located on opposite sides of the connector position assurance 44, but may include any desired number in any desired locations. As best shown in FIG. 3, each assurance catch 76 is located on a respective bridge 78 on the connector position assurance 44. Each bridge 78 is flanked by slits 80 on either side that define the bridge 78. The slits 80 extend parallel to the first connector axis 38 and pass completely through the material of the connector position assurance 44. The bridges 78 allow the respective assurance catches 76 to be deflected relative to the inner wall 74 when the connector position assurance 44 is attached to the first connector housing 36, as will be described below.

Referring back to FIG. 4, the connector position assurance 44 also includes one or more assurance stops 82 that also extend from the inner wall 74. The illustrated connector position assurance 44 includes two assurance stops 82 that are located on opposite sides of the connector position assurance 44, but may include any desired number in any desired locations. The assurance stops 82 serve to retain the connector position assurance 44 in one of a plurality of positions relative to the first connector housing 36, as will be described below.

Figure 6:
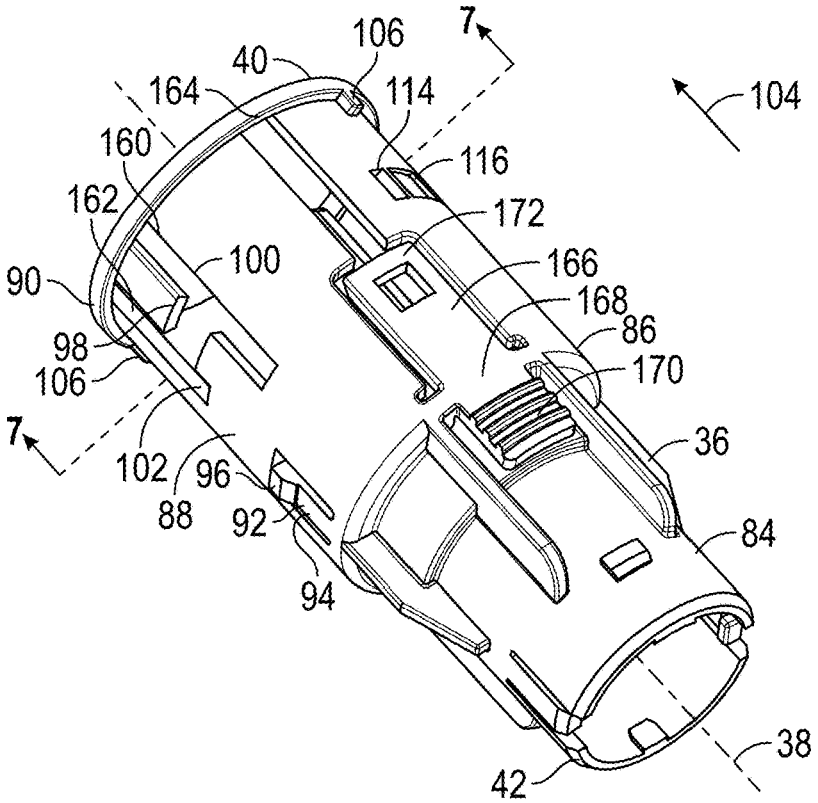
FIG. 6 is an enlarged, perspective view of a first connector housing of the first electric connector.
Figure 7:
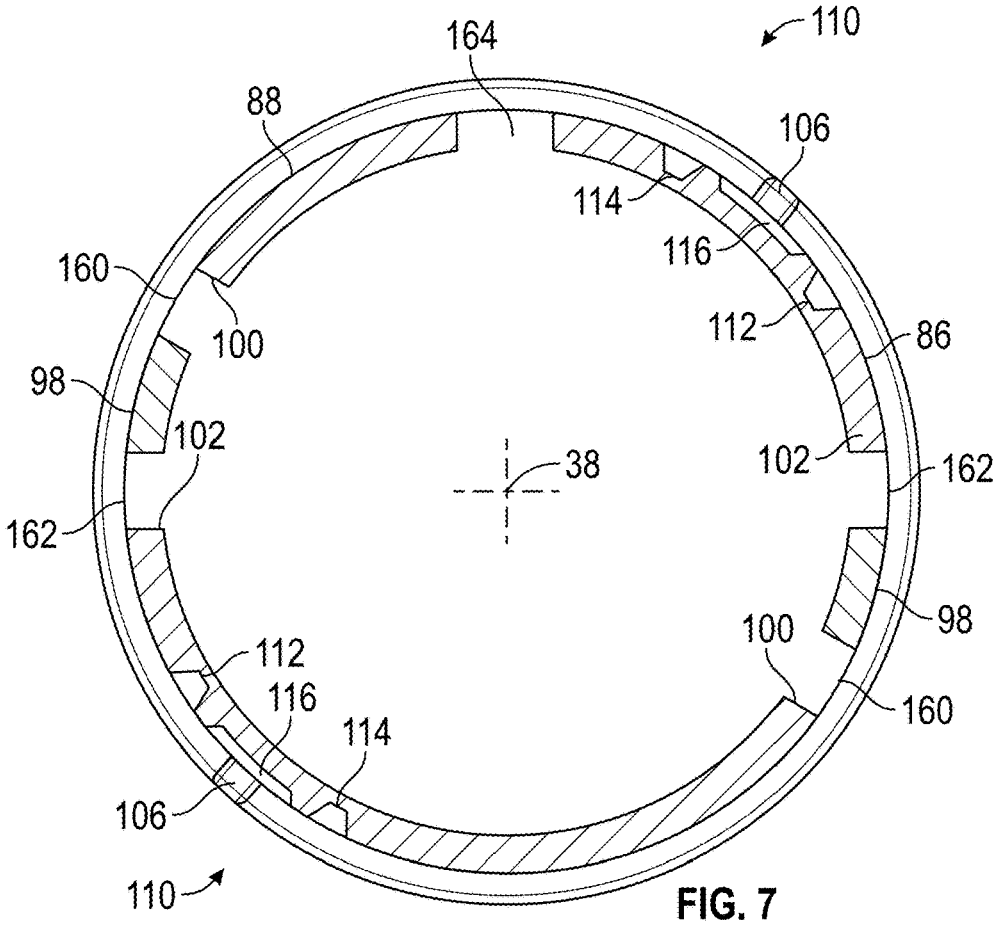
FIG. 7 is a cross-sectional view taken along lithe line 7-7 of FIG. 6.

Referring now to FIG. 6, there is illustrated an enlarged view of the first connector housing 36 from FIG. 3. In FIG. 7 there is illustrated a cross-sectional view taken along line 7-7 of FIG. 6. The first connector housing 36 includes a housing base 84 that is located at the cable end 42. An assurance support portion 86 extends from the housing base 84 to the mate end 40. The first connector housing 36 includes an assurance support surface 88 on an outer side of the assurance support portion 86. The assurance support surface 88 is the portion of the first connector housing 36 that the connector position assurance 44 is adjacent to when the first electric connector 20 is assembled, as will be described below. The assurance support surface 88 has a generally cylindrical shape and a circular cross-sectional shape viewed perpendicularly to the first connector axis 38.

The first connector housing 36 includes a flange 90 that extends away from the first connector axis 38. The flange 90 is located adjacent to the assurance support surface 88 and is located between the assurance support surface 88 and the mate end 40 of the first connector housing 36. The flange 90 serves to retain the connector position assurance 44 on the first connector housing 36, as will be described below.

The first connector housing 36 includes one or more connector position assurance retainers 92 that serve to retain the connector position assurance 44 on the first connector housing 36. The illustrated first connector housing 36 includes two connector position assurance retainers 92 (only one is visible in FIG. 6) located on opposite sides of the first connector housing 36. However, the first connector housing 36 can include any number of connector position assurance retainers 92 in any desired locations. Each connector position assurance retainer 92 includes a resilient arm 94 and a catch 96 that extends from the arm 94 away from the first connector axis 38. The catch 96 is located adjacent to the assurance support surface 88 between the assurance support surface 88 and the cable end 42 of the first connector housing 36.

The first connector housing 36 includes one or more assurance catch slots 98 (only one is visible in FIG. 6) defined in the assurance support surface 88. The illustrated first connector housing 36 includes two assurance catch slots 98 located on opposite sides of the first connector housing 36, but may include any desired number in any desired locations. Each of the catch slots 98 extends circumferentially around a portion of the first connector housing 36 between a first end 100 and a second end 102. When the connector position assurance 44 is attached to the first connector housing 36, each of the assurance catches 76 will be located in one of the assurance catch slots 98, as will be described below. The illustrated assurance catch slots 98 extend completely through the material of the first connector housing 36, but may have any desired depth.

Figure 8:
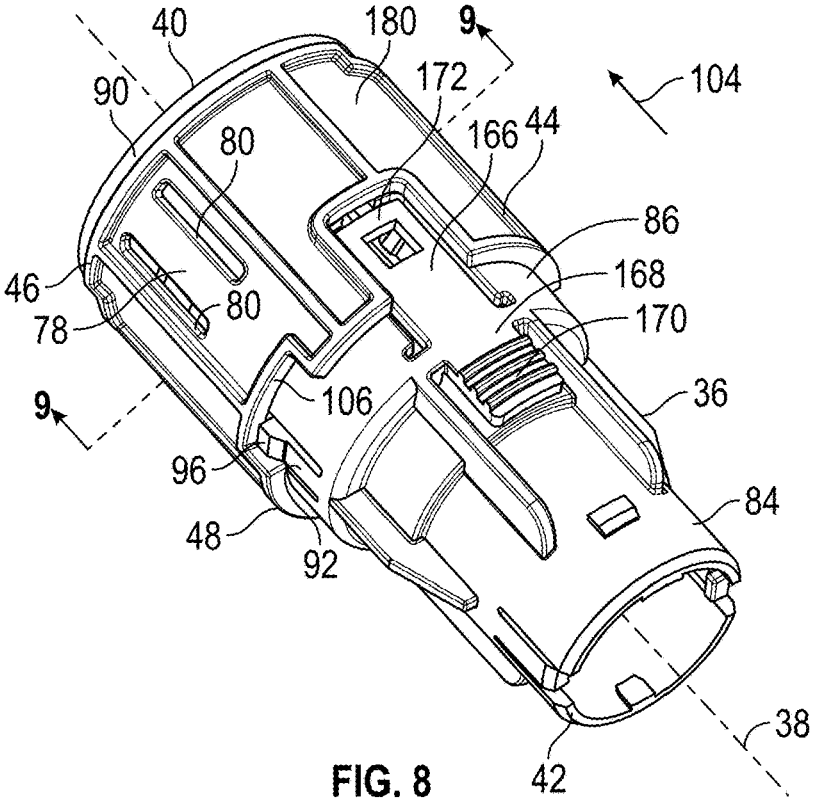
FIG. 8 is an enlarged, perspective view similar to FIG. 6 showing the connector position assurance attached to the first connector housing and in an unlocked position.

Referring now to FIG. 8, there is illustrated a perspective view of the connector position assurance 44 attached to the first connector housing 36. The connector position assurance 44 is shown in an unlocked position in FIG. 8. In order to attach the connector position assurance 44 to the first connector housing 36, the connector position assurance 44 is initially positioned with its engagement end 46 facing the cable end 42 of the first connector housing 36. The connector position assurance 44 is then moved relative to the first connector housing 36 in an attachment direction 104 so that the inner wall 74 is located on the assurance support surface 88.

As the connector position assurance 44 is moved relative to the first connector housing 36, the engagement end 46 of the connector position assurance 44 engages the catch 96 of each of the connector position assurance retainers 92 and deflects the catches 96 inwardly, toward the first connector axis 38. The connector position assurance 44 is moved in the attachment direction 104 until the engagement end 46 engages the flange 90. At that point, the connector position assurance 44 has been moved past the catches 96, and the arms 94 rebound, which move the catches 96 away from the first connector axis 38. The connector position assurance 44 is then located between the flange 90 and the catches 94, with the inner wall 74 adjacent to the assurance support surface 88. In the illustrated embodiment, the connector position assurance 44 includes retainer slots 106 at the lock end 48. The retainer slots 106 are circumferential channels in the connector position assurance 44, and each catch 94 is located in one retainer slot 106. However, the catch 94 may be located on any desired part of the connector position assurance 44.

Referring back to FIGS. 6 and 7, the first connector housing 36 includes one or more rotation tabs 107 that extend from the flange 90 onto the assurance support surface. The illustrated first connector housing 36 includes two rotation tabs 107 that are located on opposite sides of the first connector housing 36, but may include any desired number in any desired locations. Referring back to FIGS. 4 and 5, the connector position assurance 44 includes one or more rotation slots 108 at the engagement end 46. Each of the rotation slots 108 extends circumferentially around a portion of the first connector housing 36. The illustrated connector position assurance 44 includes two rotation slots 108 located on opposite sides of the connector position assurance 44, but may include any desired number at any desired locations. When the connector position assurance 44 is attached to the first connector housing 36, each of the rotation tabs 107 is located in one of the rotation slots 108. The connector position assurance 44 is mounted to the first connector housing 36 for relative rotation between the unlocked position (illustrated in FIG. 8) and a locked position (illustrated in FIG. 2). Each rotation tab 107 moves within the respective rotation slot 108 when the connector position assurance 44 is moved relative to the first connector housing 36. The rotation tab 107 will engage an end of the respective rotation slot 108 to limit rotation of the connector position assurance 44 relative to the first connector housing 36.

Referring back to FIGS. 6 and 7, the first connector housing 36 includes one or more rotation detents, indicated generally at 110. The illustrated first connector housing 36 includes two rotation detents 110 that are located on opposite sides of the first connector housing 36, but may include any desired number at any desired locations. Each of the rotation detents 110 is defined in the assurance support surface 88 and includes an unlocked detent 112, a locked detent 114, and an intermediate channel 116. When the connector position assurance 44 is attached to the first connector housing 36, each of the assurance catches 76 is located in one of the rotation detents 110. When the connector position assurance 44 is in the unlocked position, each assurance catch 76 is located in one of the unlocked detents 112. When the connector position assurance 44 is in the locked position, each assurance catch 76 is located in one of the locked detents 114. The assurance catch 76 will pass through the intermediate channel 116 when the connector position assurance 44 is moved between the unlocked position and the locked position. The assurance catches 76 cooperate with the rotation detents 110 to respectively retain the connector position assurance 44 in the unlocked position and the locked position relative to the connector housing 36. The assurance catches 76 and the rotation detents 110 also provide tactile feedback to the operator when the connector position assurance 44 has been moved to the unlocked position and to the locked position.

Referring back to FIG. 5, each assurance catch 76 includes an assurance catch release surface 118 on a side of the assurance catch 76 facing the engagement end 46. As the connector position assurance 44 is moved relative to the first connector housing 36, the assurance catch release surface 118 will engage the first connector housing 36. The assurance catch release surface 118 is sloped relative to the attachment direction 104 so that as the connector position assurance 44 is moved in the attachment direction 104, a force is applied to the assurance catch 76 that pushes the assurance catch 76 away from the first connector axis 38. As previously described, each assurance catch 76 is located on a respective bridge 78 that allow the respective assurance catches 76 to be deflected relative to the inner wall 74. As a result, the assurance catches 76 are deflected away from the first connector axis 38 as the connector position assurance 44 is moved relative to the first connector housing 36. When the connector position assurance 44 has been moved to the unlocked position, each connector position assurance 44 is located in one of the assurance catch slots 98, and the connector position assurance 44 will rebound toward the first connector axis 38. When the connector position assurance 44 is in the unlocked position, each assurance catch 76 is located adjacent to the first end 100 of the respective assurance catch slot 98. When the connector position assurance 44 is rotated to the locked position, each assurance catch 76 moves in the respective assurance catch slot 98 to the second end 102.

Figure 9:
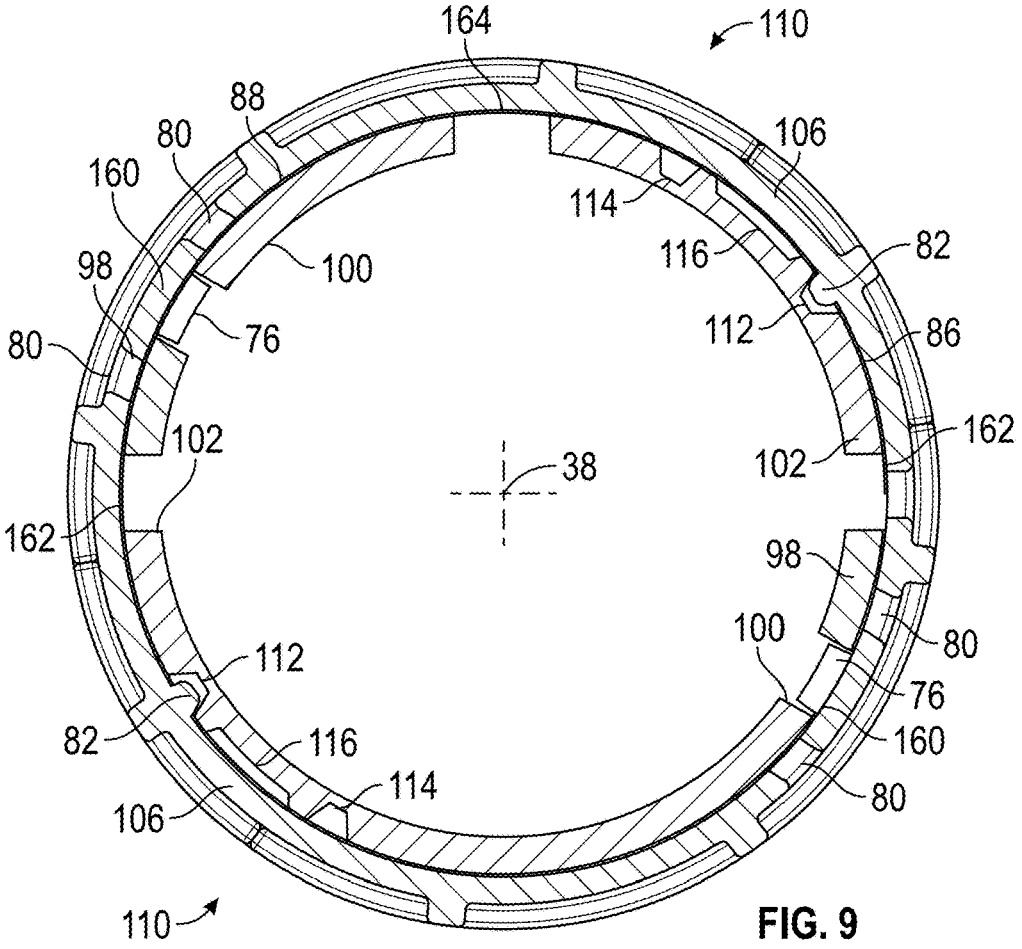
FIG. 9 is a cross-sectional view taken along line 9-9 of FIG. 8.

Referring to FIG. 9, there is illustrated a cross-sectional view taken along line 9-9 of FIG. 8. The cross-section is taken along the same line as FIG. 7, and shows the connector position assurance 44 attached to the first connector housing 36 and in the unlocked position.

Figure 10:
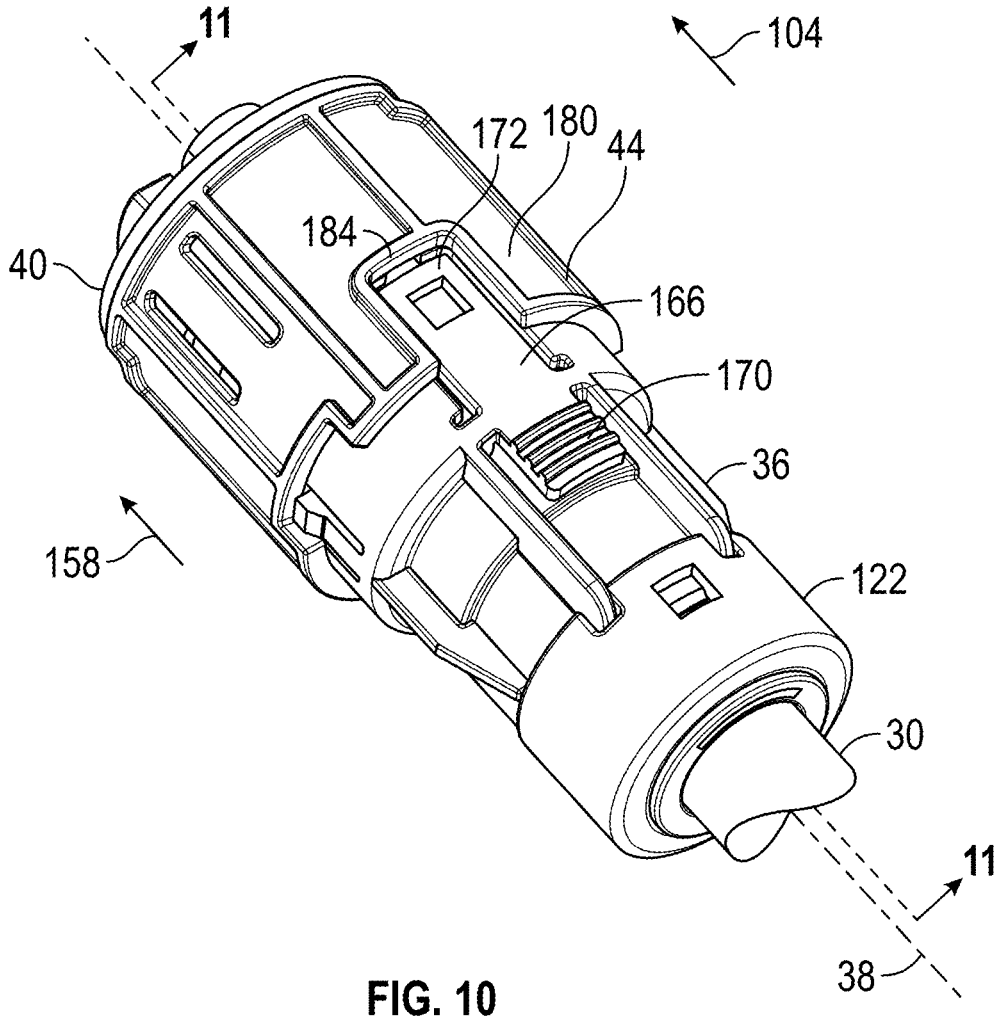
FIG. 10 is a perspective view of the assembled first electric connector.
Figure 11:
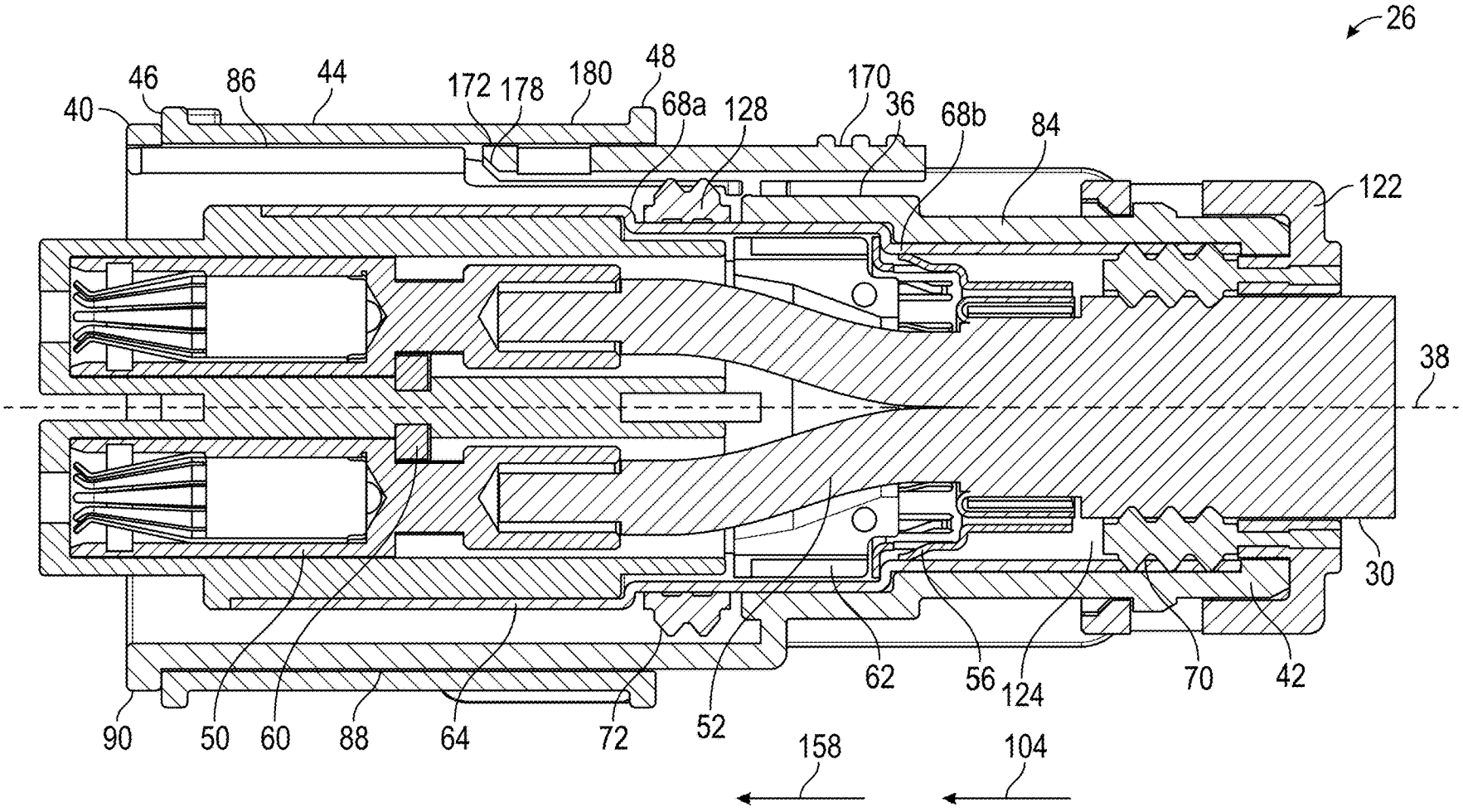
FIG. 11 is a cross-sectional view taken along line 11-11 of FIG. 10.

Referring now to FIG. 10, there is shown a perspective view of the assembled first electric connector 26, with the connector position assurance shown in the unlocked position. FIG. 11 is a cross-sectional view taken along line 11-11 of FIG. 10. In order to complete the assembly of the first electric connector 26, the first primary electric terminals 50 and the shorting bar 54 are inserted into the inner housing 58. The terminal position assurance 60 is inserted to retain the first primary electric terminals 50 in place. Each of the first primary electric terminals 50 is attached to onto one of the first primary conductors 52. In the illustrated embodiment, the first primary conductors 52 are attached to the first primary conductors 52 by crimping, but any desired connection may be used. The spacer 62 is positioned between the inner housing 58 and the ferrule 56, and the electromagnetic shield 64 is positioned around the inner housing 58. The illustrated electromagnetic shield 64 includes shield tabs 120 (shown in FIG. 3) that engage the inner housing 58 to retain the electromagnetic shield 64 in position. The first connector housing 36 is positioned around the electromagnetic shield 64, and an end cap 122 is located around the shielded cable 30 and is attached to the first connector housing 36 adjacent to the cable end 42. The illustrated end cap 122 is molded from plastic, but may be made of any desired material and by any desired method.

As illustrated in FIG. 11, the cable seal 70 is located between the electromagnetic shield 64 and the shielded cable 30. The cable seal 70 is engaged with an inner surface 124 of the electromagnetic shield 64. Additionally, the housing seal 72 is located between the electromagnetic shield 64 and the first connector housing 36. The housing seal 72 is engaged with an outer surface 126 of the electromagnetic shield 64. The housing seal 72 is located in a seal seat 128 that is defined between the step 68*a* of the electromagnetic shield 64 and part of the first connector housing 36. The seal seat 128 restricts movement of the housing seal 72 in the attachment direction 104 relative to the first connector housing 36 and relative to the electromagnetic shield 64.

Figure 12:
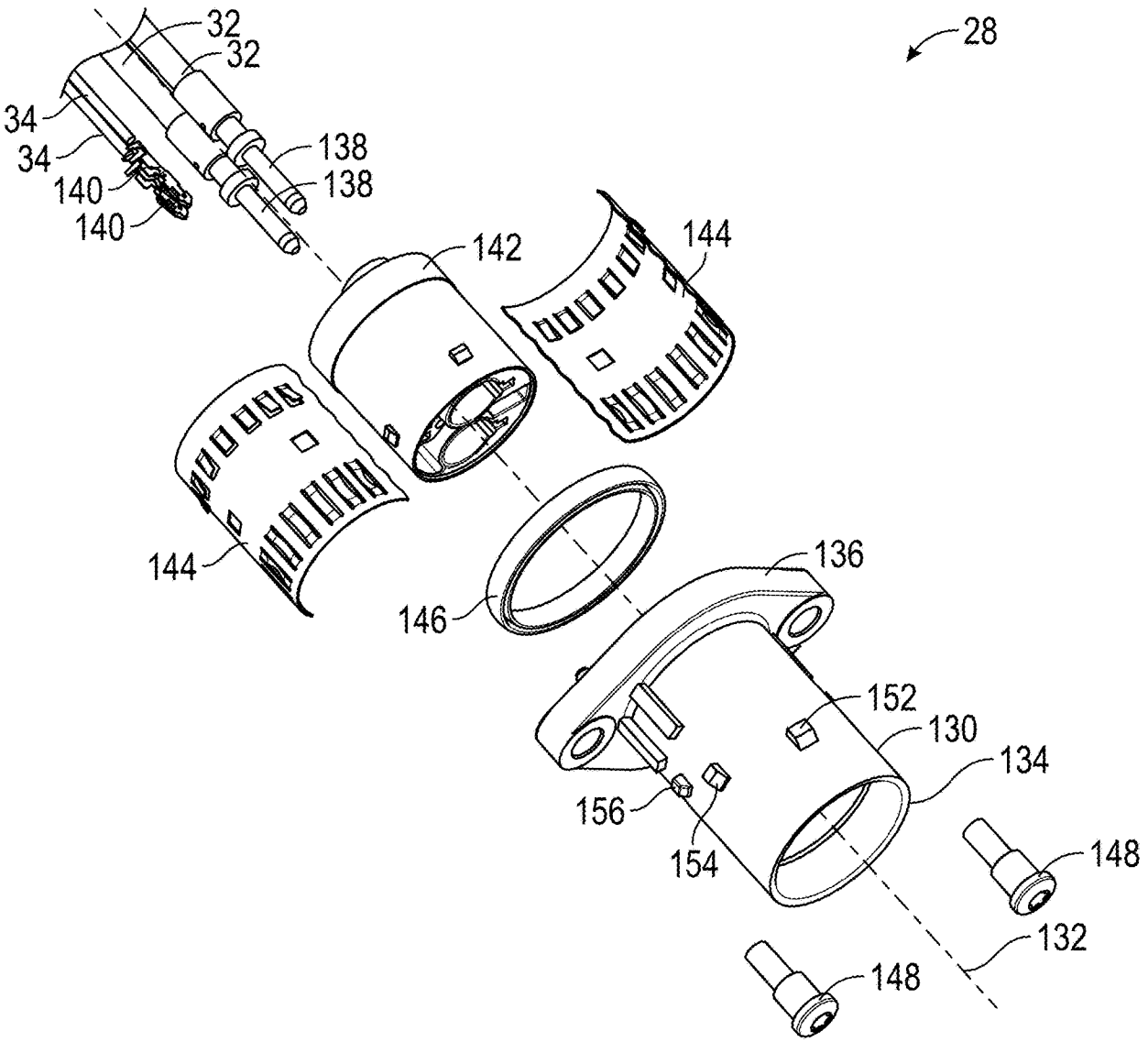
FIG. 12 is an exploded view of a second electric connector of the electric connector assembly.

Referring now to FIG. 12, there is illustrated an exploded view of the second electric connector 28. The second electric connector 28 includes a second connector housing 130 that extends along a second connector axis 132 from a mate end 134 to a cable end 136. The illustrated second connector housing 130 is molded from plastic, but may be made of any desired material and by any desired process.

The second electric connector 28 includes two second primary electric terminals 138. The illustrated second primary electric terminals 138 are male, pin-type terminals, but may be any desired types of terminals. When the second electric connector 28 is assembled, the second primary electric terminals 138 are connected to respective ones of the second primary conductors 32. The illustrated second primary electric terminals 138 are connected to the second primary conductors 32 by crimping, but any desired connection method may be used. The second electric connector 28 also includes two second secondary electric terminals 140 that are part of the interlock loop 22. Each second secondary electric terminal 140 is attached to a respective secondary conductor 34. The illustrated second secondary electric terminals 140 are also connected to the secondary conductors 34 by crimping, but any desired connection method may be used. The operation of the second primary electric terminals 138 and the second secondary electric terminals 140 will be described below.

The second electric connector 28 includes a second inner housing 142. The illustrated second inner housing 142 is molded from plastic, but may be made of any desired material and by any desired process. The second inner housing 142 supports the second primary electric terminals 138 and the second secondary electric terminals 140 when the second electric connector 28 is assembled. The second electric connector 28 also includes a second electromagnetic shield 144. The illustrated second electromagnetic shield 144 is made from two pieces sheet metal, bent to the illustrated shape. However, the second electromagnetic shield 144 may be made of any desired material and by any desired process. When the second electric connector 28 is assembled, the second electromagnetic shield 144 engages a ground (not shown) on the battery housing.

The second electric connector 28 also includes a header seal 146. The header seal 146 is an elastomeric O-ring, but may be any desired type of seal. The header seal 146 serves to prevent moisture and contaminants from reaching the second primary electric terminals 138 and the second secondary electric terminals 140 when the electric connector assembly 20 is mated, as will be described below.

Figure 13:
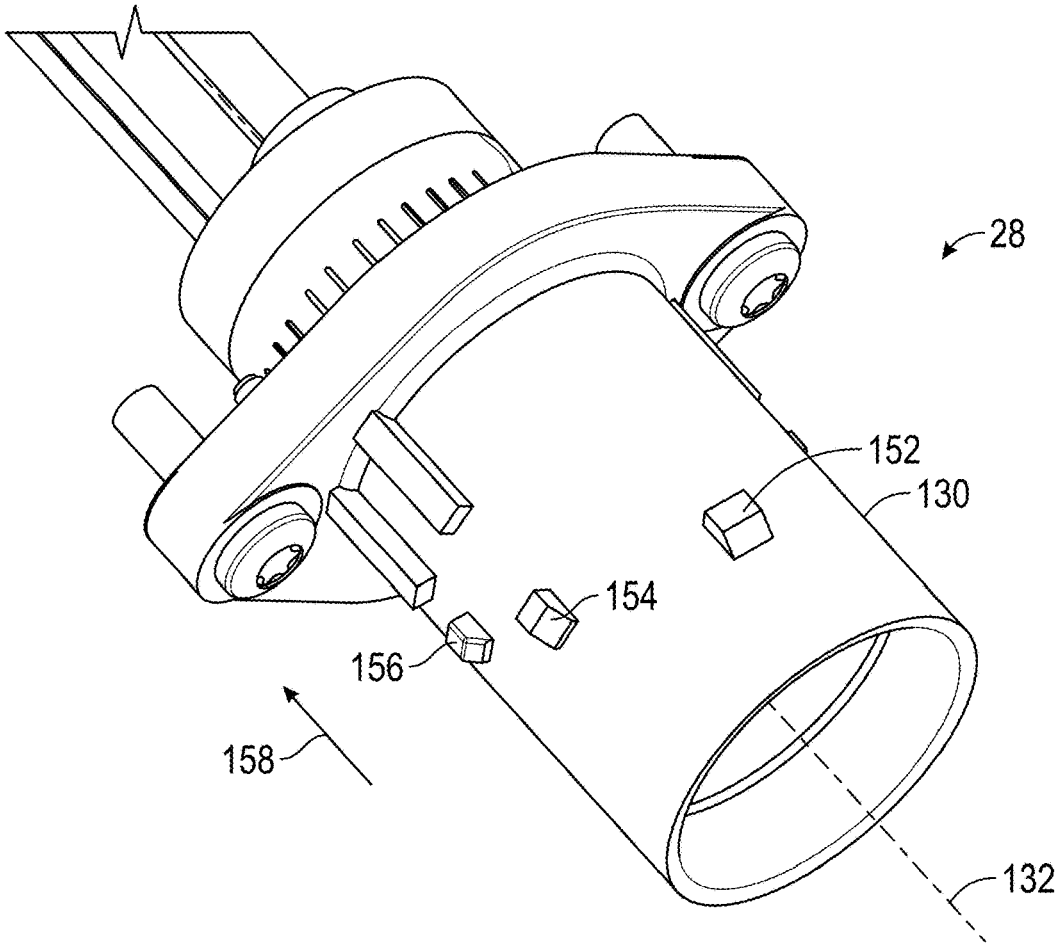
FIG. 13 is an enlarged, perspective view of the assembled second electric connector.

Referring to FIG. 13, there is illustrated a perspective view of the assembled second electric connector 28. To assemble the second electric connector 28, the second primary electric terminals 138 and the second secondary electric terminals 140 are positioned inside the second inner housing 142. The second electromagnetic shield 144 is positioned around the second inner housing 142. The second electromagnetic shield 144 is snapped inside the second connector housing 130. The second connector housing 130 is adapted to be mounted to the battery housing using two bolts 148. When the second connector housing 130 is so mounted, the header seal 146 is located between the second connector housing 130 and the battery housing. As previously described, the illustrated second electric connector 28 is provided for illustrative purposes, and the second electric connector 28 may be any desired type of electric connector.

Figure 14:
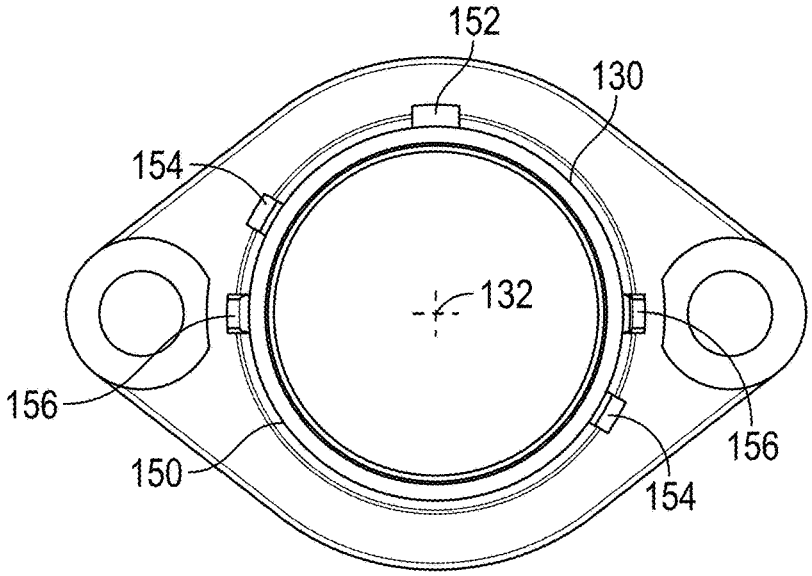
FIG. 14 is an end view of a second connector housing of the second electric connector.

Referring to FIG. 14, there is illustrated an end view of the second connector housing 120, viewed from the mate end 134. The second connector housing 120 has a generally cylindrical shape and a circular cross-sectional shape when viewed perpendicularly to the second connector axis 132. The second connector housing 120 includes an outer surface 150 that faces away from the second connector axis 132. A connector catch 152 extends from the outer surface 150. The illustrated second connector housing 120 includes one connector catch 152, but may include any desired number. The second connector housing 120 also includes one or more unlock stops 154 and one or more lock stops 156 that extend from the outer surface 150. The illustrated second connector housing 120 includes two unlock stops 154 that are located on opposite sides of the second connector housing 120, and two lock stops 156 that are located on opposite sides of the second connector housing 120, but may include any desired number at any desired locations. The unlock stops 154 and the lock stops 156 interact with the connector position assurance 44 when the first electric connector 26 and the second electric connector 28 are unmated, as will be described below.

In order to mate the first electric connector 26 and the second electric connector 28, the first electric connector 26 is initially positioned with the first connector axis 38 aligned with the second connector axis 132, the mate end 40 facing the mate end 134, and the connector position assurance 44 in the unlocked position. The first electric connector 26 is then moved relative to the second electric connector 28 in a mate direction 158, so that the first electric connector 26 engages the second electric connector 28. In the illustrated embodiment, the mate direction 158 is the same direction as the attachment direction 104, but the mate direction 158 may have any desired relative orientation.

Referring back to FIG. 9, the first electric connector 26 includes one or more unlock channels 160 and one or more lock channels 162. The illustrated unlock channels 160 and lock channels 162 are located in the first connector housing 36 and extend from the mate end 40 parallel to the first connector axis 38 (as shown in FIG. 6). The illustrated first connector housing 36 includes two unlock channels 160 that are located on opposite sides of the first connector housing 36 and two lock channels 162 that are located on opposite sides of the first connector housing 36, but may include any desired number at any desired locations. The illustrated unlock channels 160 and lock channels 162 pass completely through the material of the first connector housing 36, but may have any desired depth. Each unlock channel 160 passes through one of the assurance catch slots 98 adjacent to the first end 100. Also, each lock channel 162 passes through one of the assurance catch slots 98 adjacent to the second end 102.

The first electric connector 26 also includes one or more latch channels 164. The illustrated latch channel 164 is located in the first connector housing 36 and extends from the mate end 40 parallel to the first connector axis 38. The illustrated first connector housing 36 includes one latch channel 164, but may include any desired number at any desired locations. The illustrated latch channel 164 passes completely through the material of the first connector housing 36, but may have any desired depth.

When the first electric connector 26 is mated with the second electric connector 28, the first electric connector 26 is oriented so that each of the unlock stops 154 enters one of the unlock channels 160, and so that each of the lock stops 156 enters one of the lock channels 162. Additionally, the first electric connector 26 is oriented so that the connector catch 152 enters the latch channel 164. As previously described, the illustrated embodiment includes only one connector catch 152 and one latch channel 164. As a result, the first electric connector 26 and the second electric connector 28 can only be mated when they are located in one desired relative orientation. If the first electric connector 26 and the second electric connector 28 are not located in the desired relative orientation, then the connector catch 152 will engage the mate end 40 of the first connector housing 36 and prevent further movement in the mate direction 158. Thus, the connector catch 152 serves as an orientation feature for the electric connector assembly 20.

As best shown in FIG. 8, the first electric connector 26 includes a lever 166. The lever 166 is attached to the first connector housing 36 at a pivot bar 168 and is able to deflect relative to the housing base 84. The lever 166 includes a press surface 170 that is located on one side of the pivot bar 168 and a latch 172 that is located on the opposite side of the pivot bar 168. The latch 172 is located in the latch channel 164. The lever 166 is adapted to be actuated by the operator by applying a force to the press surface 170 to move the lever 166 from a closed position (shown in FIG. 8) to an opened position.

Figure 15A:
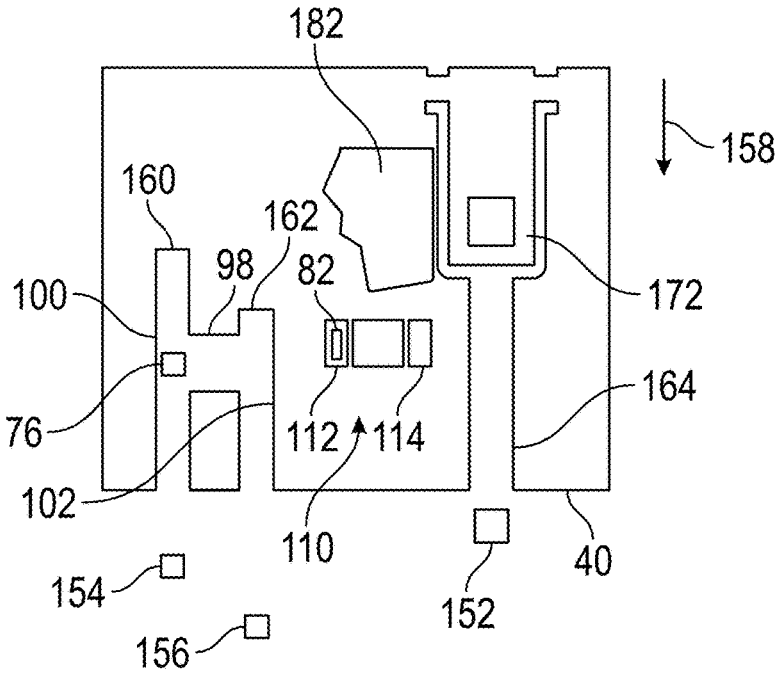

Referring to FIG. 15A, there is illustrated a schematic, cross-sectional view of a portion of the electric connector assembly 20. FIG. 15A illustrates a side view of the first connector housing 36 and shows the unlock channel 160, the lock channel 162 and the latch channel 164 extending from the mate end 40. The assurance catch slot 98 and the rotation detent 110, as well as the latch 172 are also illustrated. FIG. 15A also illustrates the relative locations of parts of the second electric connector 28 including the connector catch 152, the unlock stop 154, and the lock stop 156. Finally, FIG. 15A illustrates the relative locations of parts of the connector position assurance 44 including the assurance catch 76 and the assurance stop 82.

FIG. 15A shows the electric connector assembly 20 in the initial position, wherein the first electric connector 26 is positioned with the first connector axis 38 aligned with the second connector axis 132, the mate end 40 facing the mate end 134, and the connector position assurance 44 in the unlocked position. The first electric connector 26 is shown before it is engaged with the second electric connector 28.

Figure 15B:
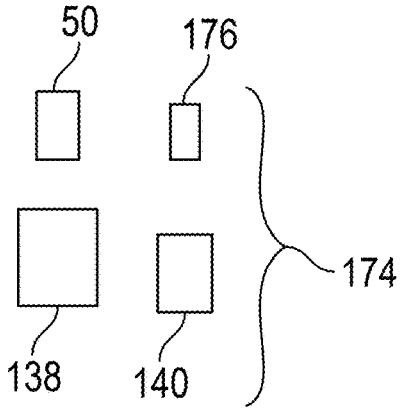

Referring to FIG. 15B, there is illustrated a schematic view of a terminal assembly, indicated generally at 174. The terminal assembly 174 includes the first primary electric terminals 50, first secondary electric terminals 176, the second primary electric terminals 138, and the second secondary electric terminals 140. The first secondary electric terminals 176 are located on the shorting bar 54. FIG. 15B shows the relative positions of these electric terminals in the terminal assembly 174 when the electric connector assembly 20 is in the initial position and none of the electric terminals is mated. At this point the primary circuit 18 is open and the interlock loop 22 is open.

Figure 16A:
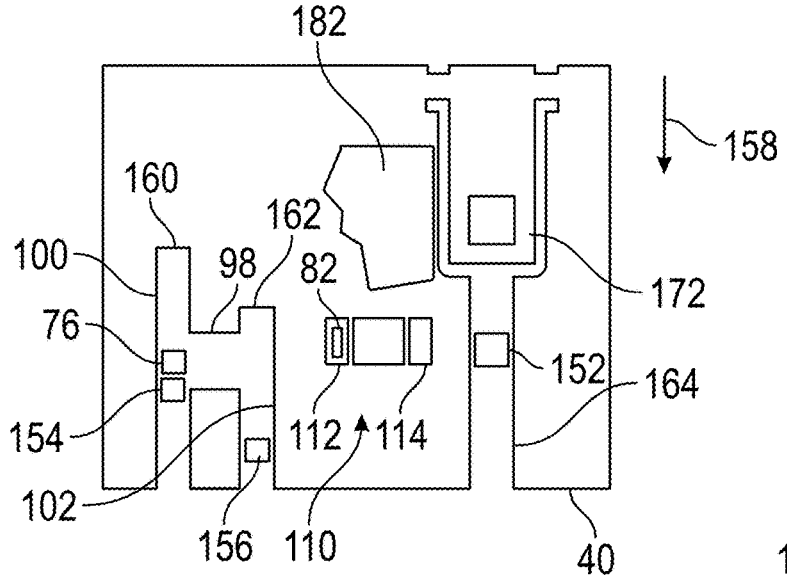
Figure 16B:
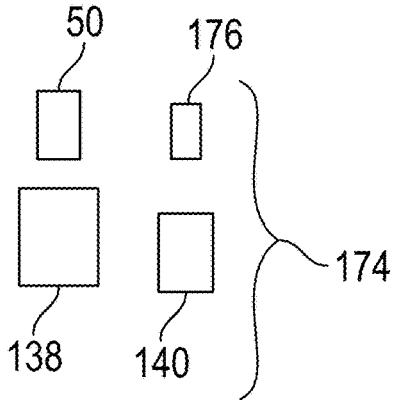

Referring to FIG. 16A, there is illustrated a view similar to FIG. 15A showing the first electric connector 26 moved from the initial position in the mate direction 158 relative to the second electric connector 28. As previously described, the unlock stop 154 enters the unlock channel 160, the lock stop 156 enters the lock channel 162, and the connector catch 152 enters the latch channel 164. Because the connector position assurance 44 is in the unlocked position, the assurance catch 76 is located adjacent to the first end 100 of the assurance catch slot 98. As previously described, the unlock channel 160 passes through the assurance catch slot 98 adjacent to the first end 100. As a result, the assurance catch 76 engages the unlock stop 154.

As previously described, the assurance catch release surface 118 (shown in FIG. 5) is located on the side of the assurance catch 76 facing the engagement end 46 of the connector position assurance 44. When the first electric connector 26 is moved in the mate direction 158 relative to the second electric connector 28, the unlock stop 154 engages the assurance catch release surface 118 of the assurance catch 76. The force applied to the assurance catch release surface 118 by the unlock stop 154 pushes the assurance catch 76 away from the first connector axis 38. As a result, the first electric connector 26 can continue to be moved in the mate direction 158 relative to the second electric connector 28.

Figure 17A:
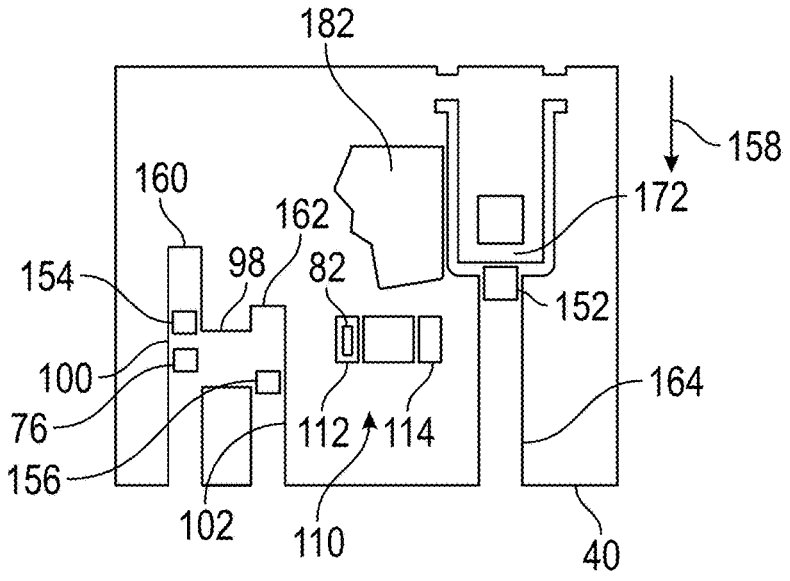
Figure 17B:
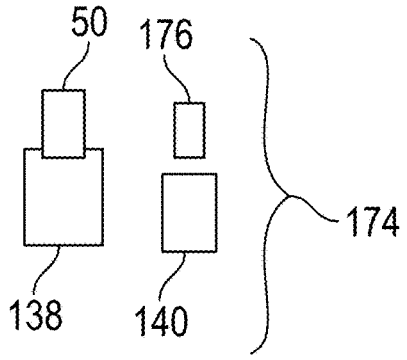

Referring to FIG. 17A, there is illustrated a view similar to FIG. 16A showing the first electric connector 26 after having been moved farther in the mate direction 158 relative to the second electric connector 28. As shown, the connector catch 152 has moved in the latch channel 164 and has engaged the latch 172. Referring back to FIG. 11, the latch 172 includes a latch release surface 178 that is sloped relative to the mate direction 158 so that the connector catch 152 will apply a force to the latch 172 and push the latch 172 away from the first connector axis 38 and out of the latch channel 164. As a result, the lever 166 will be moved to the open position, and the first electric connector 26 can continue to be moved in the mate direction 158 relative to the second electric connector 28.

Figure 18A:
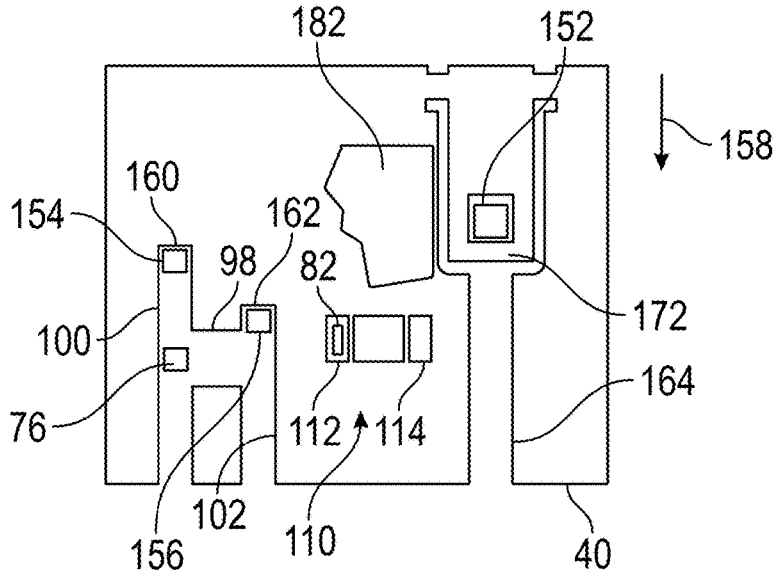

Referring to FIG. 18A, there is illustrated a view similar to FIG. 17A showing the first electric connector 26 after having been moved farther in the mate direction 158 relative to the second electric connector 28. FIG. 18A shows the electric connector assembly 20 in the mated position, wherein the first electric connector 26 is mated with the second electric connector 28. The connector catch 152 has been moved past the latch 172, and the latch 172 has rebounded into the latch channel 164.

Figure 18B:
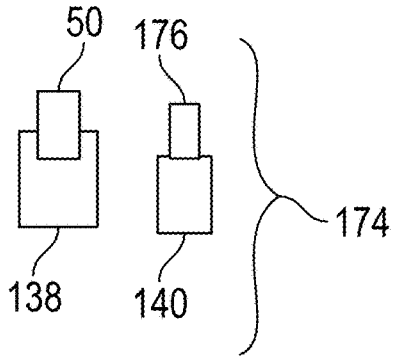

FIG. 18B illustrates the state of the terminal assembly 174 when the electric connector assembly 20 is in the mated position. When the electric connector assembly 20 is in the mated position, the first primary electric terminals 50 are mated with the second primary electric terminals 138, and the primary circuit 18 is closed. Additionally, the first secondary electric terminals 176 are mated with the second secondary electric terminals 140, and the interlock loop 22 is closed.

The first electric connector 26 is moved relative to the second electric connector 28 in a single motion from the initial position (illustrated in FIG. 15A) to the mated position (illustrated in FIG. 18A). Thus, the operator may align the first electric connector 26 with the second electric connector 28 and push the first electric connector 26 in the mate direction 158. The assurance catch 76 and the latch 127 will deflect and rebound without any additional action on the part of the operator.

Figure 19A:
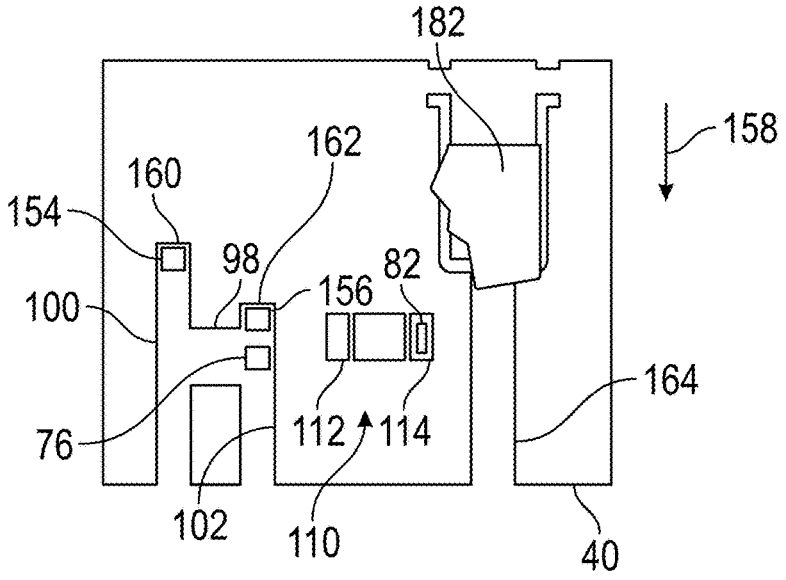
Figure 19B:
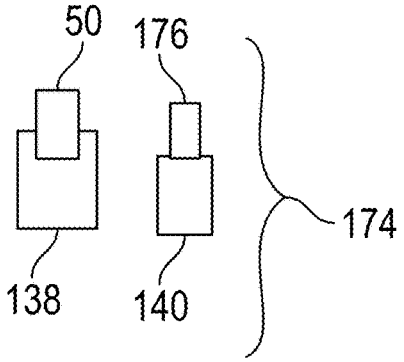

Referring to FIG. 19A, there is illustrated a view similar to FIG. 18A showing the connector position assurance 44 after having been moved relative to the first electric connector 26 to the locked position. The electric connector assembly 20 is then in a locked position illustrated in FIG. 2. The connector position assurance 44 includes a latch block 180 that prevents the latch 172 from moving to the opened position when the connector position assurance 44 is in the locked position. As shown in FIG. 2, the illustrated latch block 180 is a portion of the connector position assurance 44 that is located adjacent to the lever 166 in the radial direction. Thus, when the connector position assurance 44 is in the locked position, the latch block 180 prevents the latch 172 from being moved radially away from the first connector axis 38 and out of the latch channel 164.

When the electric connector assembly 20 is in the locked position, a force applied to the first electric connector 26 to move it opposite the mate direction 158 relative to the second electric connector 28 is resisted by the connector catch 152 engaging the latch 127. Additionally, this force is resisted by the lock stops 156 engaging the assurance catches 76. As previously described, when the connector position assurance 44 is in the locked position, the assurance catch 76 is located adjacent to the second end 102 of the assurance catch slot 98.

Referring back to FIG. 5, the assurance catch 76 includes an assurance catch stop surface 182 that is located on the opposite side from the assurance catch release surface 118. The illustrated assurance catch stop surface 182 extends substantially perpendicularly to the first connector axis 38 and the mate direction 158. As a result, the force applied to the assurance catch stop surface 182 in the mate direction 158 will not push the assurance catch 76 away from the first connector axis 38.

Figure 20A:
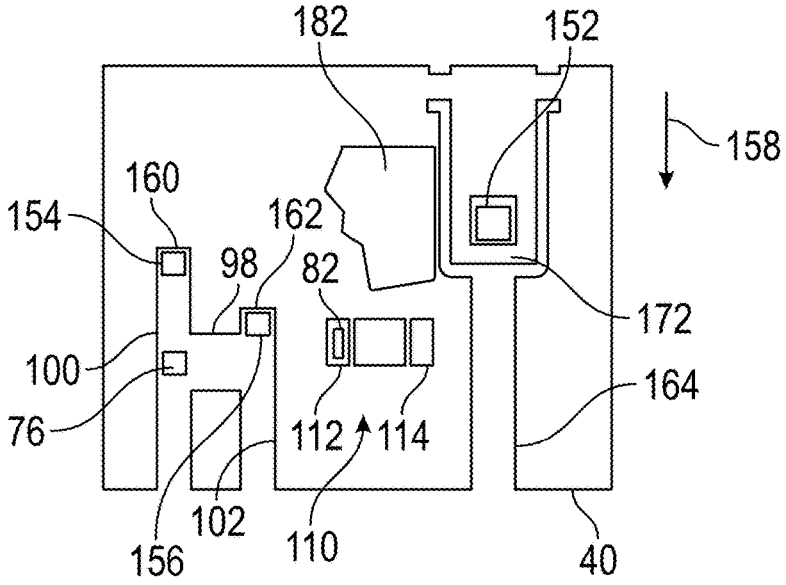
Figure 20B:
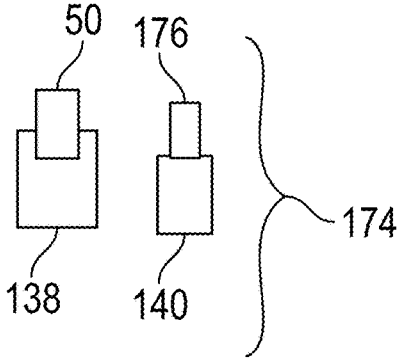

In order to unmate the first electric connector 26 from the second electric connector 28, the connector position assurance 44 is moved to the unlocked position. This is schematically illustrated in FIG. 20A. The electric connector assembly 20 is still in the mated position previously described in reference to FIGS. 18A and 18B.

Figure 21A:
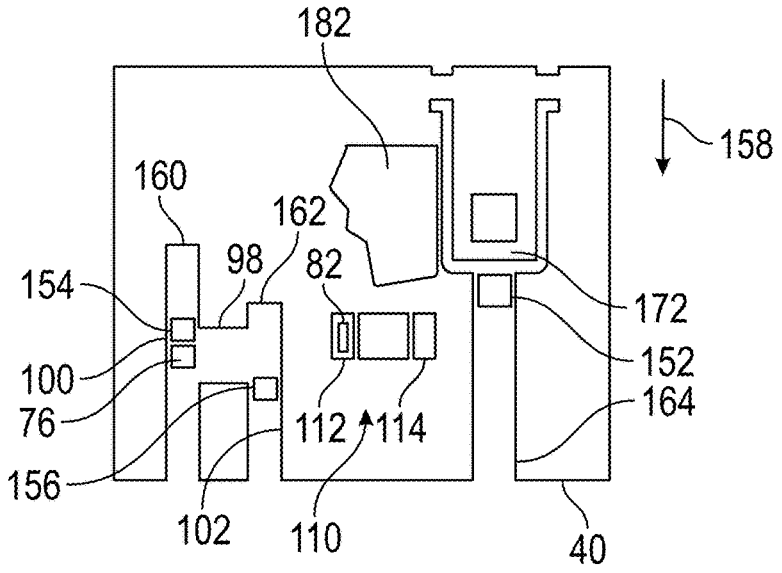

From the mated position, the latch 172 may be moved out of the latch channel 164. In the illustrated embodiment, the latch 172 is moved by the operator applying a force to the press surface 170, which moves the lever 166 from the closed position to the open position. However, any desired type of release mechanism for the latch 172 may be used. With the latch 172 in the open position, the first electric connector 26 is moved relative to the second electric connector 28 opposite the mate direction 158. The first electric connector 26 may be moved until the unlock stop 154 engages the assurance catch 76. This is schematically illustrated in FIG. 21A. The unlock stop 154 engages the assurance catch stop surface 182 and, as a result, the assurance catch 76 is not moved out of the unlock channel 160. Thus, further movement of the first electric connector 26 relative to the second electric connector 28 opposite the mate direction 158 is blocked. The electric connector assembly 20 is then in an interlock open position.

Figure 21B:
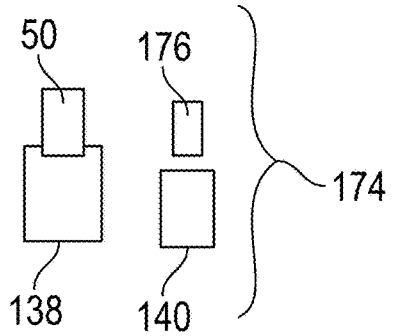

Referring to FIG. 21B, when the electric connector assembly 20 is in the interlock open position, the first primary electric terminals 50 are mated with the second primary electric terminals 138, and the primary circuit 18 is closed. However, the first secondary electric terminals 176 are disconnected from the second secondary electric terminals 140, and the interlock loop 22 is open.

As best shown in FIG. 10, the connector position assurance 44 includes a latch space 184 that the latch 172 moved into when the latch 172 is in the open position. The illustrated latch space 184 is a U-shaped opening that opens onto the lock end 48 of the connector position assurance 44. However, the latch space 184 may have any desired shape. When the latch 172 is in the open position, the latch 172 will engage the connector position assurance 44 to prevent the connector position assurance 44 from moving from the unlocked position to the locked position. Referring to FIG. 10, when the press surface 170 is pressed down toward the first connector axis 38, the latch 172 is moved upwardly away from the first connector axis 38. If an attempt is made to rotate the connector position assurance 44 to the locked position, the latch block 180 on the connector position assurance 44 will engage the latch 172 and prevent movement of the connector position assurance 44. When the latch 172 returns to the closed position, the connector position assurance 44 may be moved relative to the first connector housing 36.

Figure 22A:
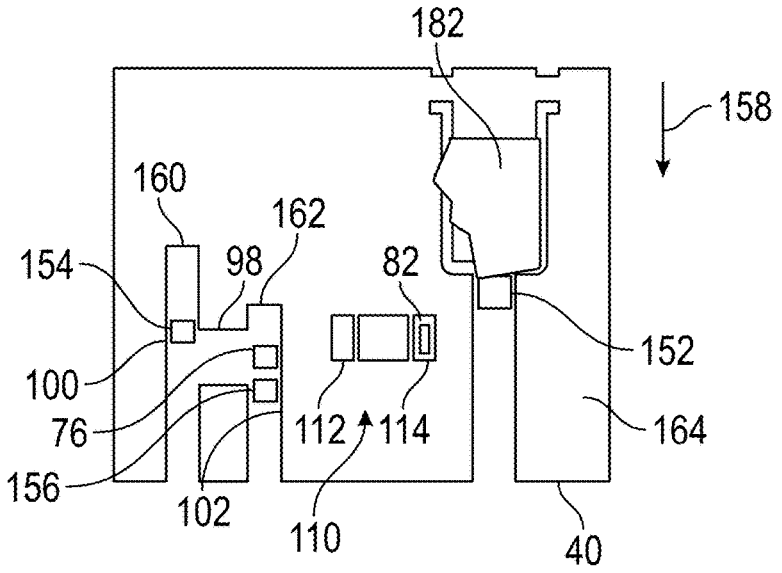
Figure 22B:
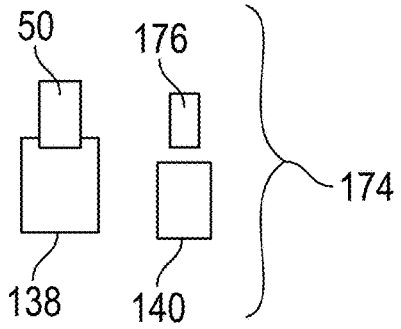

Referring back to FIG. 21A, with the electric connector assembly 20 in the interlock open position, the latch 172 is moved to the closed position, and the connector position assurance 44 is then moved to the locked position. This is illustrated schematically in FIG. 22A. The assurance catch 76 is moved to the second end 102 of the assurance catch slot 98 and, thus, no longer blocks movement of the unlock stop 154. From this position, the first electric connector 26 is moved relative to the second electric connector 28 opposite the mate direction 158 back to the initial position (illustrated in FIG. 15A).

The first electric connector 26 is moved relative to the second electric connector 28 in a multiple-stage motion from the mated position (illustrated in FIG. 20A) to the initial position (illustrated in FIG. 15A). Thus, a delay is introduced between when the interlock loop 22 is opened and when the primary circuit 18 is opened.

In normal use of the electric connector assembly 20, the connector position assurance 44 is moved to the unlocked position before the first electric connector 26 is mated with the second electric connector 28. If the connector position assurance 44 is in the locked position when the first electric connector 26 is aligned with the second electric connector 28 and moved in the mate direction 158, the connector catch 152 will engage the latch release surface 178 of the latch 172, but will be unable to push it out of the latch channel 164. This would be the state of the electric connector assembly 20 illustrated in FIG. 22A, wherein the assurance catch stop surface 182 prevents the latch 172 from moving out of the closed position.

When the electric connector assembly 20 is in the mated position illustrated in FIG. 2, the electromagnetic shield 64 in the first electric connector 26 is engaged with the second electromagnetic shield 144 in the second electric connector 28. This provides a continuous electromagnetic shield from the shielded cable 30 to the battery housing. Additionally, the housing seal 72 in the first electric connector 26 is engaged with the second connector housing 130 of the second electric connector 28.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric connector comprising:

a connector housing including a latch that is movable between an opened position and a closed position; and a connector position assurance supported on the connector housing for rotational movement relative to the connector housing between a locked position and an unlocked position such that when the connector position assurance is in the locked position, the latch is prevented from moving from the closed position to the opened position, and wherein the connector position assurance includes an assurance catch that is located in a circumferential catch slot on the connector housing, and the assurance catch is located on a resilient bridge on the connector position assurance.

2. The electric connector of claim 1, wherein when the latch is in the opened position, the connector position assurance is prevented from moving from the unlocked position to the locked position.

3. An electric connector assembly comprising:

a first electric connector including a first connector housing having a latch that is movable between an opened position and a closed position;

a second electric connector movable relative to the first electric connector between an initial position and a mated position, the second electric connector including a second connector housing having a connector catch that is engaged by the latch to retain the second electric connector in the mated position when the latch is in the closed position; and a connector position assurance supported on the first connector housing for rotational movement relative to the first connector housing between a locked position and an unlocked position such that when the connector position assurance is in the locked position, the latch is prevented from moving from the closed position to the opened position, wherein the connector position assurance includes an assurance catch that is located in a circumferential catch slot on the first connector housing.

4. The electric connector assembly of claim 3, wherein when the latch is in the opened position, the connector position assurance is prevented from moving from the unlocked position to the locked position.

5. The electric connector assembly of claim 3, wherein the assurance catch is located on a resilient bridge on the connector position assurance.

6. The electric connector assembly of claim 3, wherein the first connector housing includes a lock channel that extends from a mate end of the first connector housing through the catch slot and an unlock channel that extends from the mate end of the first connector housing through the catch slot.

7. The electric connector assembly of claim 6, wherein when the connector position assurance in the locked position, the assurance catch is located in the lock channel, and wherein when the connector position assurance in the unlocked position, the assurance catch is located in the unlock channel.

8. The electric connector assembly of claim 7, wherein the second connector housing includes an unlock stop that is located in the unlock channel when the second electric connector in the mated position and a lock stop that is located in the lock channel when the second electric connector in the mated position.

9. The electric connector assembly of claim 8, wherein when the connector position assurance is in the unlocked position and the second electric connector is moved from the mated position toward the initial position, the assurance catch engages the unlock stop to prevent movement of the second electric connector relative to the first electric connector at an interlock open position.

10. The electric connector assembly of claim 9, wherein when the connector position assurance is in the locked position and the second electric connector is moved from the mated position toward the initial position, the assurance catch engages the lock stop to prevent movement of the second electric connector relative to the first electric connector.

11. The electric connector assembly of claim 9, wherein when the connector position assurance is in the unlocked position and the second electric connector is moved from the initial position toward the mated position, the assurance catch engages the unlock stop and biases the unlock stop out of the unlock channel.

12. An electric connector comprising:

a connector housing including a latch that is movable between an opened position and a closed position; and a connector position assurance supported on the connector housing for rotational movement relative to the connector housing between a locked position and an unlocked position such that when the connector position assurance is in the locked position, the latch is prevented from moving from the closed position to the opened position, and wherein the connector position assurance includes an assurance catch that is located in a circumferential catch slot on the connector housing, and the connector housing includes a lock channel that extends from a mate end of the connector housing through the catch slot and an unlock channel that extends from the mate end of the connector housing through the catch slot.

13. The electric connector of claim 12, wherein when the latch is in the opened position, the connector position assurance is prevented from moving from the unlocked position to the locked position.

14. An electric connector comprising:

a connector housing including a latch that is movable between an opened position and a closed position; and a connector position assurance supported on the connector housing for rotational movement relative to the connector housing between a locked position and an unlocked position such that when the connector position assurance is in the locked position, the latch is prevented from moving from the closed position to the opened position, and wherein a shielded cable is attached to the connector housing, an electromagnetic shield is supported in the connector housing and electrically connected to a shield layer of the shielded cable, a cable seal is supported on an inner surface of the electromagnetic shield, and a housing seal is supported on an outer surface of the electromagnetic shield.

15. The electric connector of claim 14, wherein when the latch is in the opened position, the connector position assurance is prevented from moving from the unlocked position to the locked position.

* * * * *